US005570676A

United States Patent [19]

Gore

[11] Patent Number: 5,570,676

[45] Date of Patent: Nov. 5, 1996

[54] METHOD FOR CONVERTING A MECHANICAL SPRING GUN TO A PNEUMATIC SPRING GUN AND THE RESULTING PNEUMATIC SPRING GUN

[76] Inventor: Thomas D. Gore, 227 Coronation Ct., Canton, Mich. 48188

[21] Appl. No.: 402,471

[22] Filed: Mar. 10, 1995

Related U.S. Application Data

[63] Continuation-in-part of Ser. No. 192,018, Feb. 4, 1994, abandoned.

[51] Int. Cl.[6] ..... F41B 11/32; F41B 11/16

[52] U.S. Cl. ..... 124/56; 124/65; 124/67; 124/71; 124/73; 124/66

[58] Field of Search ..... 124/63, 64, 65, 124/66, 67, 68, 69, 56, 60, 71, 73

[56] References Cited

U.S. PATENT DOCUMENTS

| | | | |
|---|---|---|---|
| 2,101,198 | 12/1937 | Robinson | 124/69 |
| 4,572,152 | 2/1986 | Olofsson et al. | 124/69 |
| 4,709,686 | 12/1987 | Taylor et al. | 124/67 |
| 4,771,758 | 9/1988 | Taylor et al. | 124/68 |
| 4,850,329 | 7/1989 | Taylor et al. | 124/68 |
| 5,193,517 | 3/1993 | Taylor et al. | 124/65 X |
| 5,333,594 | 8/1994 | Robinson | 124/56 X |

FOREIGN PATENT DOCUMENTS

| | | | |
|---|---|---|---|
| 3638671 | 5/1988 | Germany . | |
| 469875 | 8/1975 | U.S.S.R. | 124/65 |

*Primary Examiner*—Randolph A. Reese
*Assistant Examiner*—Thomas A. Beach
*Attorney, Agent, or Firm*—Charles W. Chandler

[57] ABSTRACT

This invention is related to a kit to retrofit a mechanically spring-powered air gun to a gas spring-powered air gun, and to a self-contained gas piston for an air gun. The gas piston has a center latch which engages the center latch operated by the trigger.

10 Claims, 3 Drawing Sheets

METHOD FOR CONVERTING A MECHANICAL SPRING GUN TO A PNEUMATIC SPRING GUN AND THE RESULTING PNEUMATIC SPRING GUN

CROSS-REFERENCE TO RELATED APPLICATIONS

This application is a continuation-in-part of my U.S. patent application Ser. No. 08/192,018 entitled "Air Gun Gas Piston Device" filed on Feb. 4, 1994, now abandoned.

BACKGROUND OF THE INVENTION

Air guns use compressed air to discharge a pellet. Some air guns use a piston in a compression chamber. A spring is mounted between the piston and a trigger mechanism. The piston is retracted to cock the trigger and to compress the spring. When the trigger is released, the spring biases the piston toward the barrel to compress the air in the compression chamber. The compressed air then propels the pellet through the barrel. One problem with air guns using a mechanical spring is that the spring tends to fatigue or break, and also to produce an excessive amount of spring vibration upon firing.

Some air guns use a gas spring instead of a mechanical spring. The piston is moved toward the trigger to compress a gas or air behind the piston. When the trigger is released, the piston is driven forward by the compressed gas thereby compressing the air in front of the piston to discharge the pellet out of the barrel.

Such guns are illustrated in U.S. Pat. No. 4,709,686 which was issued Dec. 1, 1987 to Hugh F. Taylor and David R. Theobald for "Air Weapon With Gas-Tight Expansion Chamber"; U.S. Pat. No. 4,771,758 which was issued Sep. 20, 1988 to the same inventors for "Air Weapon With Air Compression System Having Grooves For Air Transfer"; and U.S. Pat. No. 4,850,329 which was issued to Jul. 25, 1989 to Hugh F. Taylor, David R. Theobald and Derek J. C. Bernard for "Firing Mechanisms For Air Weapons".

SUMMARY OF THE INVENTION

The broad purpose of the present invention is to provide a kit for converting a mechanical spring-operated air gun to a pneumatic or gas-spring operated air gun.

Another object of the invention is to provide an improved air gun having a primary air-compressing piston with an internal, self-contained power chamber having a gas that is compressed by a smaller piston as the primary piston is retracted toward a cocked position. When the trigger is actuated, the compressed gas expands to bias the primary piston toward the barrel, compressing the air in front of the piston.

Still another object of the invention is to provide an air gun with a self-contained gas piston having a center latch for engaging a center latch carried in the trigger housing.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
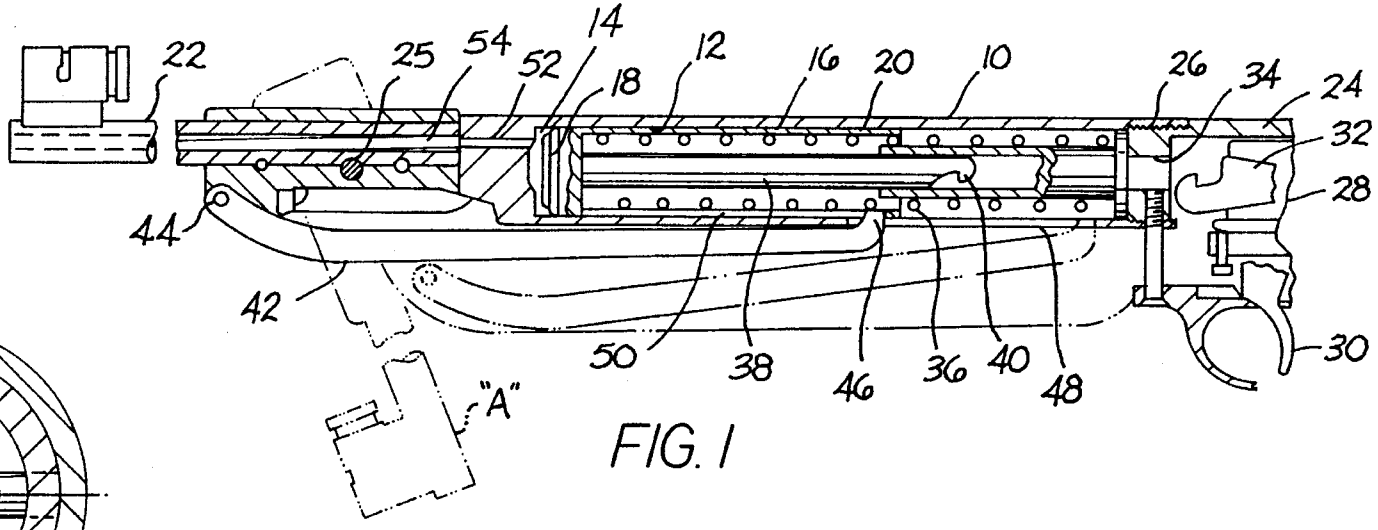
FIG. 1 is a fragmentary view of a conventional mechanical spring-operated air gun.

Referring to FIG. 1, a conventional barrel-cocking air gun 10 has an elongated cylindrical receiver tube 12 defining a compression chamber 14 at the forward or left end of the receiver tube. A primary piston 16 having a crown 18 and cylindrical wall 20 is slideably mounted in the compression chamber.

A barrel 22 is connected to the receiver tube for pivotal motion around pivot member 25, from a firing position illustrated in solid in FIG. 1 toward a fully cocked position illustrated in phantom at "A".

A trigger housing 24 is threadably mounted at 26 at the rearward end of the receiver tube. A conventional trigger mechanism 28, partially shown, operatively connects a trigger 30 to a hook-shaped latch 32 carried in the trigger housing adjacent latch opening 34.

A helical power spring 36 is mounted in the receiver tube. One end of the power spring is mounted against the trigger housing, and the opposite end engages the crown of the piston. An elongated second trigger latch 38 is carried by the piston inside the spring, and has a hook-shaped element 40 which passes through opening 34 to engage latch 32 when the power spring is fully compressed. The trigger mechanism cocks the trigger as the two latches become engaged.

A lever 42 has one end connected by pivot 44 to the barrel, and its opposite hook-shaped end 46 received through a bottom slot opening 48 in the receiver tube for engaging a recessed portion 50 of the piston. As the barrel is pivoted toward position "A", lever 42 pushes the piston toward the trigger housing thereby compressing the power spring until the two latches are in their latched position. When the trigger is pulled to release the two latches, the power spring then pushes the piston toward the left, compressing the air in the compression chamber forward of the piston. The compressed air then passes through an opening 52 to explosively propel a projectile 54 through barrel 22 in the conventional manner.

Figure 2:
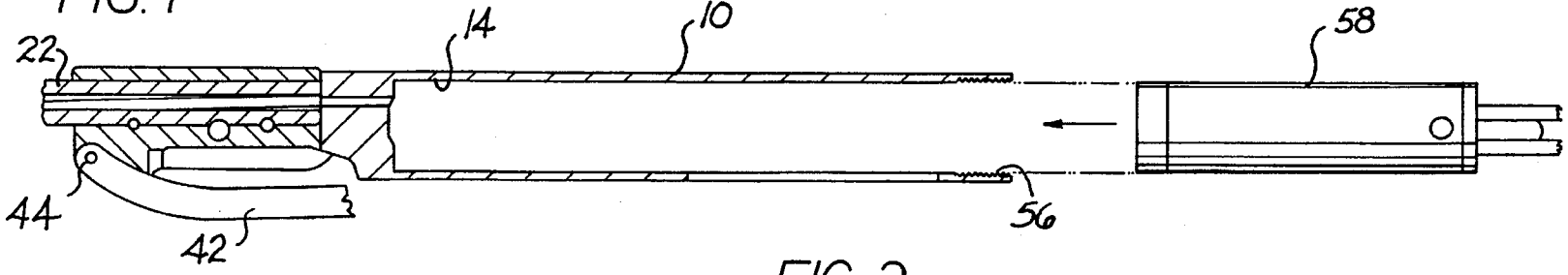
FIG. 2 illustrates the air gun with the mechanical spring and piston removed through an opening at the trigger end of the receiver tube.
Figure 7:
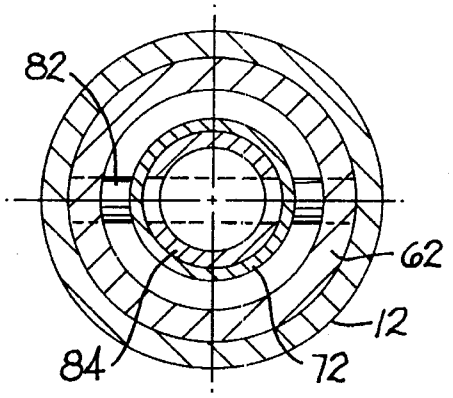
FIG. 7 is an enlarged sectional view as seen along lines 7—7 of FIG. 5.
Figure 3:
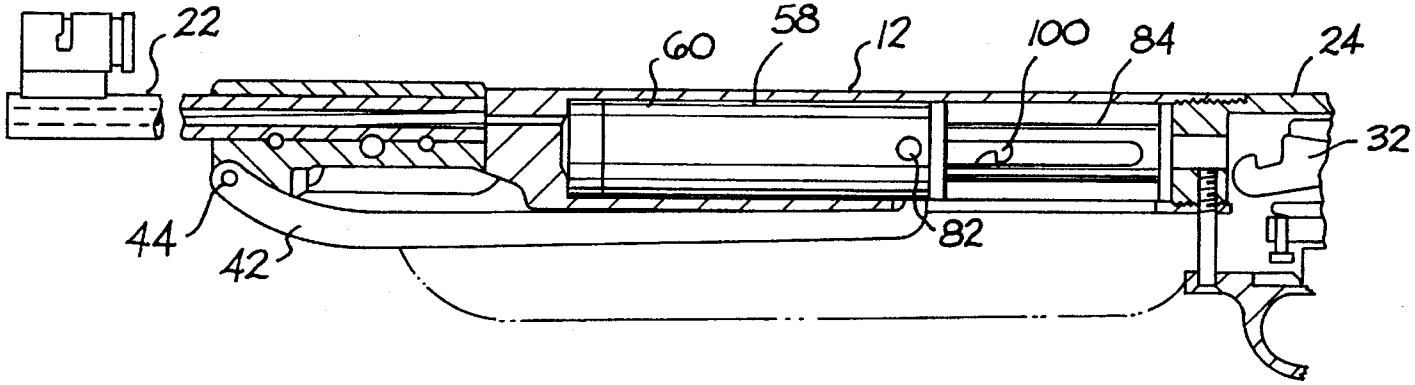
FIG. 3 is a view showing the self-contained gas piston mounted in the receiver tube of FIG. 1, in an unlatched position.

FIG. 2 illustrates air gun 10 with the trigger housing unscrewed from the receiver tube to form an opening 56. Piston 16, power spring 36, latch 40 and the related sealing components are removed from compression chamber 14. A replacement, self-contained gas piston assembly 58 is then inserted through the opening into the compression chamber.

Referring to FIGS. 3–7, the replacement gas piston assembly comprises a metal compression piston 60 having a cylindrical wall 62 with a crown 64 blocking one end of the piston. Valve means 66 provide means for introducing a gas into a power chamber 68 entirely contained in the compression piston valve means 66 can be a conventional check valve. A cap-shaped seal 70 is mounted around crown 64 and forms a sliding sealing engagement with the internal wall of the receiver tube.

An inner elongated cylindrical member 72 is carried within piston wall 62. Member 72 has an enlarged annular section 74 which closely fits the inside wall of compression piston wall 62. An annular seal 76 forms an air-tight seal between the inside of the piston wall and member 72. The outer diameter of inner cylindrical member 72 is less than that of the inner diameter of the piston wall to form an elongated annular outer gas power chamber 78. The inner end of the inner cylindrical member is shorter than the length of the piston so that an inner power chamber 88 is formed within member 72. An orifice member 80 is carried on the inner end of member 72. Member 80 has a flow orifice 94 therein connecting chambers 78 and 88.

A transverse pin 82 extends through the wall of the compression piston and through annular section 74 so that the compression piston and cylindrical member reciprocate in the compression chamber together as a unit.

An elongated tubular latch guide member 84 has one end press fitted around the central opening of a nylon washer 86 fixedly mounted adjacent the trigger housing, and its free end received inside cylindrical member 72 to form a wall of the power chamber. The latch guide has an end wall which forms a piston head 90. The piston head carries an annular seal 92 to form a sliding sealing engagement between piston head 90, and the inner wall of cylindrical member 72. Latch guide 84 and piston head 90 are fixed with respect to the receiver tube in such a manner that as the compression piston is moved toward the trigger housing, nitrogen gas, disposed within the piston, is compressed.

The gas is compressed because of the reducing volume of the power chamber in cylindrical member 72. The gas being compressed by piston head 90 in the cylindrical member is in communication through orifice 94 with that portion of the power chamber outside member 72 so that the gas pressure throughout the power chamber is uniformly compressed. The orifice member can be changed to change the orifice opening to change the rate of motion of the compression piston as the gas expands in the power chamber.

The latch guide member has an elongated longitudinal slot 96. Pin 82 extends through both sides of slot 96 thereby permitting the compression piston to move either toward or away from latch 32.

Figure 4:
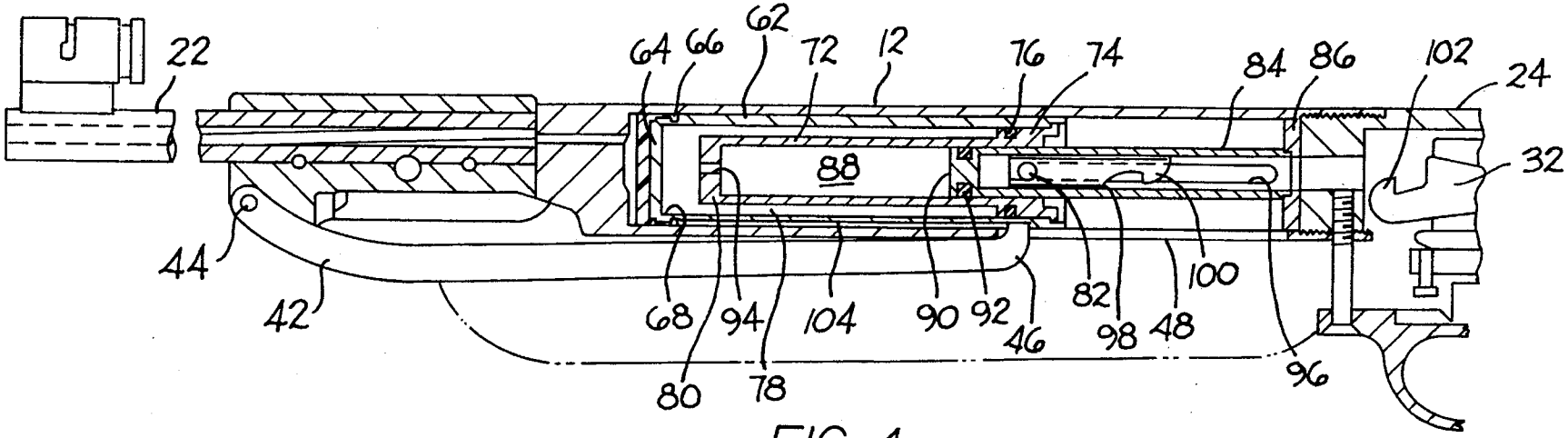
FIG. 4 is a view similar to FIG. 3 but showing the gas piston in section.

Referring to FIG. 4, a short latch 98 supported along the central longitudinal axis 99 (FIG. 5) of the compression chamber, has one end connected to pin 82 so that latch 98 moves with the pin and the compression piston. Latch 98 is disposed inside latch guide member 84 so that a hooked-shaped latch end 100 approaches the hooked-shaped end 102 of latch 32.

Figure 5:
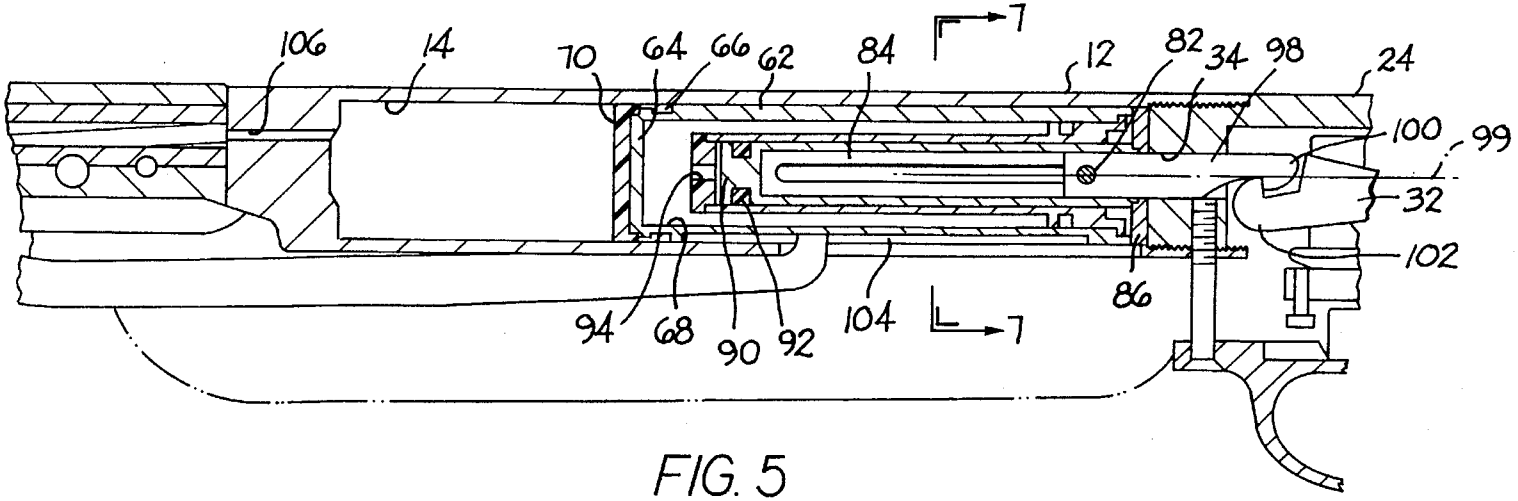
FIG. 5 is a view similar to FIG. 4 but showing the latch carried by the piston engaged with the trigger-operated latch.
Figure 6:
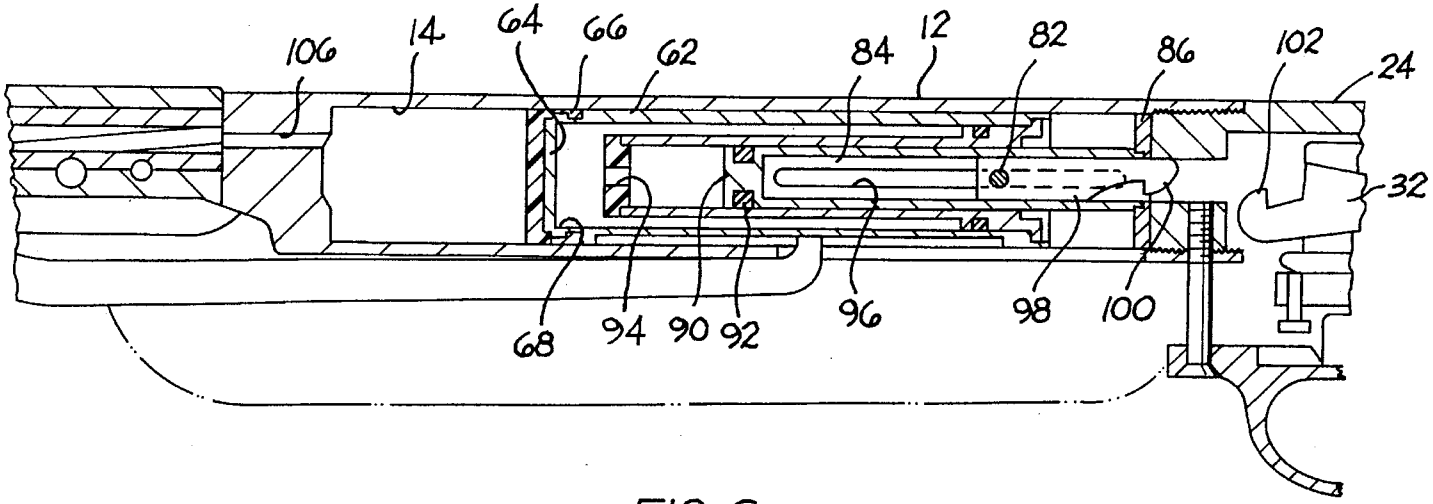
FIG. 6 is a view similar to FIG. 5 but in which the primary piston has been partially actuated in a power stroke by the compressed gas in the piston.

Referring to FIG. 5, as the compression piston is moved toward its fully latched position, latch 98 moves through opening 34 in the trigger housing to engage latch 32. Like the mechanical spring version of the gun, latch 32 is pivoted as it engages latch 98 thereby cocking trigger member 30 in the usual manner.

Referring to FIG. 4, the bottom side of the piston wall has an elongated recess 104 aligned with the longitudinal slot 48 in receiver tube 12 for engaging end 46 of the cocking lever. As barrel 22 is pivoted toward position "A", the lever engages the end of recess 104 and pushes the compression piston rearwardly until the two latches engage and cock the trigger. When the trigger is squeezed by the user in the usual manner, latch 32 is pivoted thereby releasing latch 98. The compressed gas in compression piston 60 then expands thereby moving the compression piston toward the barrel end of the compression chamber, compressing the air in front of the compression piston. The compressed air then passes through port 106 driving the projectile through the barrel in the usual manner.

Thus, it is to be understood that I have described an improved self-contained gas piston assembly that can be mounted in a conventional mechanical spring-operated air gun. The retrofit is accomplished by removing the trigger housing from the end of the receiver tube, removing the mechanical spring, the piston and related components, and then inserting the self-contained gas piston into the receiver tube. The center latch carried by the gas piston lines up with the center latch 32 of the trigger housing along the central longitudinal axis of the receiver tube. The retrofit takes place in a very few minutes thereby providing all the advantages of a gas piston gun over a mechanical spring-operated piston gun.

An air gun can also be made with the gas spring piston and the center latching mechanism as original equipment.

Having described my invention, I claim:

1. A method for converting a mechanical spring powered air gun to a gas-spring powered air gun, the air gun having a receiver tube with a compression chamber in communication with a discharging barrel; a first piston in the compression chamber movable toward the barrel to compress air for discharging a projectile through the barrel; a mechanical spring between a trigger housing and the first piston for urging the first piston toward the barrel; cocking means for retracting the first piston toward the trigger housing to a cocked position and for compressing the mechanical spring; and a trigger for releasing the first piston from the cocked position whereby the mechanical spring urges the first piston toward the barrel, comprising the steps of:

removing the trigger housing from the receiver tube to form an opening into the compression chamber;

removing the first piston and the spring through said opening from the compression chamber;

inserting a second piston having a compressible gas into the compression chamber for reciprocal movement therein;

connecting the second piston to a barrel-operated cocking lever so the second piston is moved toward the trigger housing as the barrel is pivoted with respect to the receiver tube to compress a gas in the second piston;

disposing a latch carried on the second piston for engagement with a complementary latch carried with the trigger housing; and mounting the trigger housing on the receiver tube to close said opening.

2. The method of claim 1, wherein the step of removing the trigger housing from the receiver tube comprises unthreading the housing from the tube.

3. A method of converting a mechanical spring-powered air gun to a gas spring-powered air gun, wherein said mechanical spring-powered air gun comprises a receiver tube, a discharging barrel connected to one end of said receiver tube, a trigger housing connected to the other end of said receiver tube, a first latch (32) in said trigger housing, a latch-operating trigger in said trigger housing, a first air compressing piston (16) slidably mounted in said receiver tube, a coil spring (36) for moving said first piston toward said barrel, and a second latch (38) extending axially from said first piston toward the trigger housing for releasable engagement with said first latch; said method comprising the steps of:

disconnecting said trigger housing from said receiver tube without disturbing the first latch and the trigger;

removing said first piston, the coil spring, and the second latch from the receiver tube;

providing a replacement gas piston assembly that includes a hollow air-compressing piston (60), a replacement latch (98) extending axially from said piston for releasable engagement with said first latch, and a charge of compressible gas within said hollow piston;

inserting said replacement gas piston assembly as a single self-contained unit into said receiver tube; and reconnecting said trigger housing to said receiver tube.

4. The method of claim 3, wherein the step of disconnecting said trigger housing from said receiver tube comprises unthreading said housing from said tube.

5. An air gun, comprising:

an elongated receiver tube (12) having a longitudinal axis, a barrel end, and a trigger end, said tube forming an air compression chamber;

a discharging barrel (22) mounted on the barrel end of the receiver tube for discharging a projectile as compressed air is expelled from the compression chamber through the barrel;

a compression piston (60) slideably mounted in said receiver tube for movement either toward the barrel end of said tube or the trigger end of said tube; said compression piston having a hollow elongated cylindrical piston wall (62), and a piston crown (64) on the barrel end of said cylindrical wall;

an inner elongated housing (72, 74,) located within said piston, said elongated housing comprising a hollow cylinder (72) spaced radially inwardly from said cylindrical piston wall on the receiver tube axis to form a sealed annular chamber between said cylinder and said cylindrical piston wall;

a trigger housing secured to the trigger end of said receiver tube, a manually-operated trigger (30) carried on said trigger housing, and a first trigger-operated latch (32) located in said trigger housing in alignment with the longitudinal axis of said receiver tube;

a tubular latch guide (84) extending from said trigger housing into said hollow cylinder (72) on the receiver tube axis; said tubular latch guide having a close end wall (90) within the hollow cylinder, whereby said hollow cylinder forms a closed power chamber (88) in fluid communication with said sealed annular chamber;

a compressible gas charged into said sealed annular chamber and said power chamber;

a second latch (98) located within said tubular guide for engagement with said first latch, said second latch being connected to said compression piston for movement either toward or away from said first latch; and means (42) for retracting said compression piston toward the trigger end of said receiver tube to compress the gas in said annular chamber and said power chamber, and to cause said second latch to be operatively engaged with said first latch;

said trigger being actuable to move said first latch out of engagement with said second latch, whereby the compression piston is powered toward the barrel to compress air in the compression chamber.

6. An air gun as defined in claim 5, and further comprising a single connecting means joining said compression piston, said inner elongated housing and said second latch together; said single connecting means comprising a connector pin (82) extending transversely through said compression pin, elongated housing and second latch.

7. An air gun as defined in claim 6, wherein said tubular latch guide has two axial slots (96) therein accommodating said connector pin.

8. In an air gun that comprises an elongated receiver tube (12), a discharging barrel connected to one end of said tube, and a trigger housing removably attached to the other end of said tube, said trigger housing having a first trigger-operated latch aligned axially with said tube; the improvement comprising:

a unitary gas piston assembly removably positioned in said receiver tube;

said gas piston assembly comprising a compression piston (60), an inner elongated housing (72, 74,) located within said piston, a tubular latch guide (84) telescoped within said inner housing, and a second latch (98) slidably positioned within said tubular latch guide for movement toward or away from said first trigger-operated latch;

said compression piston and said inner housing cooperatively defining a closed annular chamber surrounding said inner housing and a closed power chamber within said inner housing;

said second latch being connected to said compression piston and said inner housing for conjoint movement within the receiver tube and along the tubular latch guide.

9. The improvement of claim 8, wherein said tubular latch guide has two axial slots (96) extending therealong; and a single connector pin (82) joining said compression piston, said inner housing, and said second latch for conjoint movement; said connector pin extending through said axial slots.

10. The improvement of claim 8, wherein said unitary gas piston assembly has a connection means (82) therein, whereby the gas piston assembly is installable in the receiver tube as a single step operation.

* * * * *